US005660338A

United States Patent [19]

Emmerson

[11] Patent Number: 5,660,338

[45] Date of Patent: Aug. 26, 1997

[54] APPARATUS FOR DISPOSING OF LIGHT BULBS

[76] Inventor: Dana Emmerson, Windmill Place No. 2, 900 Windmill Road, Suite 117, Dartmouth, Nova Scotia, Canada, B3B 1P7

[21] Appl. No.: 563,531

[22] Filed: Nov. 6, 1995

[30] Foreign Application Priority Data

Jul. 19, 1995 [CA] Canada ..... 2154225

[51] Int. Cl.[6] ..... B02C 19/14

[52] U.S. Cl. ..... 241/37.5; 241/99; 241/100; 241/193

[58] Field of Search ..... 241/99, 100, 36, 241/193, 195, 37.5

[56] References Cited

U.S. PATENT DOCUMENTS

| | | | |
|---|---|---|---|
| 4,579,287 | 4/1986 | Brown | 241/99 X |
| 4,875,630 | 10/1989 | Carlson | 241/193 X |
| 5,188,500 | 2/1993 | Eide et al. | 241/193 X |
| 5,205,497 | 4/1993 | Deklerow | 241/99 X |

FOREIGN PATENT DOCUMENTS

| | | | |
|---|---|---|---|
| 696751 | 9/1940 | Germany | 241/193 |

*Primary Examiner*—Mark Rosenbaum

*Attorney, Agent, or Firm*—Ezra Sutton

[57] ABSTRACT

Apparatus is provided herein for disposing of light bulbs, e.g., fluorescent bulbs. The apparatus includes an open-topped cylindrical container covered by a removable lid. A hollow cylindrical light bulb feed chute is perpendicularly attached to, and extends through the lid along the central longitudinal axis of the lid and has an inlet opening which is and an outlet opening disposed below the lower surface of the lid. An electric motor is mounted upon the upper surface of the lid and has a downwardly-extending rotatable shaft, projecting through the lid and terminating below the lower surface of the lid. An "on-off" electrical switch operates the electric motor. Inventive structure is provided for pulverizing a light bulb, e.g., a fluorescent tube, as it emerges from the outlet opening of the feed chute. That structure comprises a hub at the terminal end of the shaft. At least two equiangularly-disposed, multi-stranded, braided, wire cables are secured to the clamp. Each multi-stranded, braided, wire cable is provided with a terminal weight. When the shaft is rotating, each multi-stranded, braided, wire cable extends by centrifugal force across the outlet opening of the chute into the path of the bulb and strikes the hollow cylindrical light bulb at right angles to the direction of feeding of the hollow cylindrical light bulb as the shaft rotates. The cables pulverize the bulb by the combined initial breaking and subsequent abrasive action of the multi-stranded, braided, wire cables.

3 Claims, 1 Drawing Sheet

APPARATUS FOR DISPOSING OF LIGHT BULBS

BACKGROUND OF THE INVENTION (a) Field of the Invention

This invention relates to an apparatus for disintegrating light bulbs, more particularly, fluorescent lamps and for simultaneously providing a holding unit to contain such disintegrated fluorescent lamps in an environmentally-safe manner.

(b) Description of the Prior Art

Fluorescent lamps are mercury-vapour electric-discharge lamps, in which the inside of the bulb or tube is coated with fluorescent material so that ultra-violet radiation from the discharge is converted to light of an acceptable colour. Such lamps take advantage of fluorescence, which is the production of visible light (white or coloured) or other radiation by a substance as the result of exposure to, and absorption of, other radiations of different wave length, such as ultraviolet light, or electric discharge in a vacuum tube. Those substances having this property are known as phosphors, the term usually being restricted to those solids that absorb ultraviolet and emit visible light. In ordinary fluorescent lighting, the tube contains mercury vapour and argon, and the inside walls of the tube are coated with the fluorescent substance, often a zinc or cadmium compound. The passage of an electric current through the mercury vapour-argon mixture produces invisible ultraviolet light which is absorbed by the phosphor and re-emitted as visible light. The whole process occurs at a relatively low temperature (hence called a "cold light" process).

Among the numerous substances which are known to exhibit phenomenon of fluorescence may be mentioned fluorite, uranium glass, petroleum, solutions of certain organic dyestuffs, eosin, fluorescein, quinine sulphate chlorophyll, and the vapour of sodium, mercury, iodine, and acetone.

Because of the contents of such fluorescent lamps, their disposal brings about environmental concerns, particularly where such fluorescent tubes are commonly disposed of with the everyday trash. It would therefore be desirable to provide a system for safely disintegrating such fluorescent lamps.

Various patented arrangements have been proposed for breaking up fluorescent tubes, bottles or the like into small pieces. Most of these however, particularly the arrangements therein for preventing escape of phosphorus and mercury which are present in fluorescent tubes, are complicated, requiring vacuum or pressure pumps and the like for their operation.

U.S. Pat. No. 4,655,404 discloses a fluorescent lamp crusher device which includes a replaceable filter cartridge for capturing or otherwise removing mercury vapours which are released upon the crushing of fluorescent lamps. Replaceable cartridges of the type described above include activated carbon, which is very effective in removing objectionable mercury vapours from the air during operation of the crusher, provided that the charcoal or carbon particles be replaced or replenished whenever they become saturated with mercury.

U.S. Pat. No. 3,623,672 patented November 1971 by W. de Frank purported to provide an apparatus for breaking up and disposing of burned-out and defective glass fluorescent lamp bulb tubes. That fluorescent tube disposing apparatus was entirely mounted on a lid of a mating, open-top, standard 20-gallon trash can. The patented disposal apparatus included an inlet chute to receive the fluorescent tubes, and a motor mounted underneath the lid for rotating a tube-breaking chain. A stop was positioned a predetermined distance below the outlet end of the inlet chute to hold a fluorescent tube in a position where it can be acted upon by the rotating breaking means. The means for breaking the fluorescent tube was a breaking chain which includes metal chain links connected by connectors to the motor driving shaft. Each metal chain was provided with a terminal metal washer. As the tube was broken, it automatically fed itself into the can. The inlet chute included a telescoping protective tube substantially entirely to enclose the fluorescent tube. A safety switch was also included, which prevented the motor from being energized unless the telescoping protective tube was raised or lifted to its upwardly extended position.

U.S. Pat. No. 3,913,849 patented Oct. 31, 1975 by I. M. Atanasoff et al purported to provide a tube digester which served to prevent the escape of phosphorus and mercury vapours without requiring the provision of pumps for either pressure or suction. That tube digester was formed of a container in the shape of a funnel having an open bottom, which was adapted to be inserted in a bunghole in a storage drum. A tube for receiving fluorescent tubes opened into the container at one side. Within the container was a rotating blade which passed beneath the opening of the tube for breaking up fluorescent tubes. The axis of the tube was arranged in a plane which was tangential with respect to the axis of rotation of the blade. The tube sloped downwardly in the direction of rotation of the blade. The blade had a rearwardly and downwardly sloping surface for creating a downward draft of air within the funnel to prevent phosphorus and mercury vapours from escaping outward. A slightly downwardly sloping shelf was arranged beneath the tube and below the plane of rotation of the blade, by a distance at least equal to the length of the terminal prongs of a fluorescent tube. The leading edge of the blade formed an acute angle with the radius drawn from the axis of rotation to the top of the leading edge.

U.S. Pat. No. 4,579,287 patented Apr. 1, 1980 by W. E. Brown purported to provide apparatus for breaking up and disposing of burned-out glass fluorescent lamp bulb tubes. Such apparatus utilized rapidly rotating chains to pulverize the tubes. The pulverizing mechanism was confined within an open-top container and was suspended from a lid that covered the top of the container. The pulverized debris collected within the container. A plastic bag may line the interior of the container to facilitate disposal of the pulverized debris. A safety electrical switch was associated with the lid in a manner to prevent rotation of the chains if the lid was not properly sealed upon the top of the container.

U.S. Pat. No. 4,655,404 patented Apr. 7, 1987 by J. W. Deklerow purported to provide a fluorescent lamp crusher. That crusher comprised a cylindrical crusher housing mounted on a carriage above a removable waste bucket, which communicated with a funnel-shaped discharge formed in the lower end of the housing. The top of the housing was sealed by a cover which had a lamp inlet opening and an exhaust opening. The shaft of an electric motor extended into the housing and had a plurality of flails or crusher elements secured thereto. The flails, adjacent the inlet opening, rotated at high speeds to strike and crush lamps entering the housing. The exhaust opening was connected by a duct to a filter cartridge which was removably-mounted on the exterior of the crusher housing above an exhaust fan. The cartridge contained a porous filter bag, which was removably-attached to the exhaust duct, and an activated charcoal filter element, which was positioned in the cartridge beneath the bag and was in communication with the fan inlet. The exhaust fan operated simultaneously with the crusher motor to develop a vacuum which served to draw exhaust air from within the housing successively through the filter bag and the charcoal filter element. The filter element was specially treated to remove mercury vapour from the exhaust air that passed through the element. The crusher elements were constituted by a metal plate which was secured to the motor drive shaft. Hooks which were secured to the ends of the metal plate were connected to flails.

U.S. Pat. No. 5,205,497 patented Apr. 27, 1993 by J. W. Deklerow purported to provide a lamp crusher. That lamp crusher housing was mounted on the removable cover of a replaceable waste container to discharge crushed lamps into the waste container through an opening in the cover. An elongate, plastic sleeve was removably and sealingly secured at one end over the upper end of the waste container, and at its opposite end around the outlet of the housing from which crushed lamp particles were discharged. The sleeve had an excess portion folded into the waste container so that when the cover was lifted from the container, opposite ends of the sleeve bag remained sealingly connected to the waste container and housing outlet so that no toxic gases were allowed accidentally to escape into their surrounding atmosphere. The apparatus included a replaceable filter cartridge for filtering out mercury vapours, and the like. Each cartridge contained a fuse which was connected in the circuit that controlled the motor that drove the lamp crusher. When a new cartridge was placed in the apparatus its fuse was connected into the control circuit and permitted only a predetermined number of lamp crushing operations to occur. After such finite number of operations the motor was prevented from further operation until the saturated cartridge was replaced by a new, clean cartridge. The crusher element included a cylindrical bar or flail which was connected to the shaft of the motor.

SUMMARY OF THE INVENTION (a) Aims of the Invention

It is readily apparent that none of the above patents provided a machine of exceptionally simple and inexpensive construction that could disintegrate hazardous material and retain such material in a convenient container for safe disposal.

Accordingly, it is one object of this invention to provide a machine for the safe disintegration of fluorescent lamps.

Another object of this invention is to provide a relatively light-weight easily and safely operable such machine.

Yet another object of this invention is to provide a portable such disposal unit, which will effectively disintegrate fluorescent lamps.

(b) Statement of Invention

This invention provides an apparatus for disposing of light bulbs, comprising: an open-topped cylinder container; a substantially-flat lid adapted removably to mate with, and to cover, the top of the container, the lid having an upper surface, and a lower surface which is adapted to be directed downwardly toward the container; a hollow cylindrical light bulb feed chute which is disposed along the central longitudinal axis of the lid extending through the lid and being attached thereto, having an inlet opening disposed above the upper surface of the lid and an outlet opening disposed below the lower surface of the lid, the inside diameter of hollow cylinder being adapted closely to accommodate the fluorescent tube, the feed chute extending perpendicularly through the lid. An electric motor is mounted upon the upper surface of the lid and is clamped thereto and has a downwardly-extending rotatable shaft, which projects through the lid and which terminates below the lower surface of the lid. An on-off electrical switch is operatively associated with the electric motor. Means are provided for pulverizing a light bulb, as it emerges from the cutlet opening of the feed chute, the means comprising a hub at the terminal end of the shaft are at least two equiangularly-disposed, rough multi-stranded, braided, wire cable secured to the hub, each the multi-stranded, braided, wire cables being provided with a terminal weight. Accordingly, when the shaft is rotating, each the multi-stranded, braided, wire cables extends by centrifugal force across the outlet opening of the chute, thereby to pulverize the bulb by the first breaking the hollow cylindrical light bulb into small particles and then by grinding the small particles by abrasion against the rough surface of each multi-stranded, braided wire cable. This simultaneously generates a pressure ambient to prevent undesirable backup into the inlet of the hollow cylindrical chute. Each of the multi-stranded braided wire cables strikes the hollow cylindrical light bulb at an angle to the direction of feeding of the light bulb, in turn, as the shaft rotates. thereby to pulverize the bulb by the combined breaking and abrasive action of the multi-stranded, braided, wire cables.

(c) Features of the Invention

By another feature of this invention, the apparatus includes: an electrical safety switch pendently supported by the lower surface of the lid and adapted to inactivate the motor switch when the lid is raised from the open-topped container.

By yet another feature of this invention, the apparatus also includes: a plastic liner bag, the open upper extremity of which drapes over the open top of the container and is held within the container in which position by the lid the plastic liner bag providing a disposable vessel for the pulverized bulb.

BRIEF DESCRIPTION OF THE DRAWINGS

In the accompanying drawings, the single FIGURE is an exploded, central, longitudinal, cross-section through one embodiment of the present invention.

DESCRIPTION OF THE PREFERRED EMBODIMENT

Figure 1:
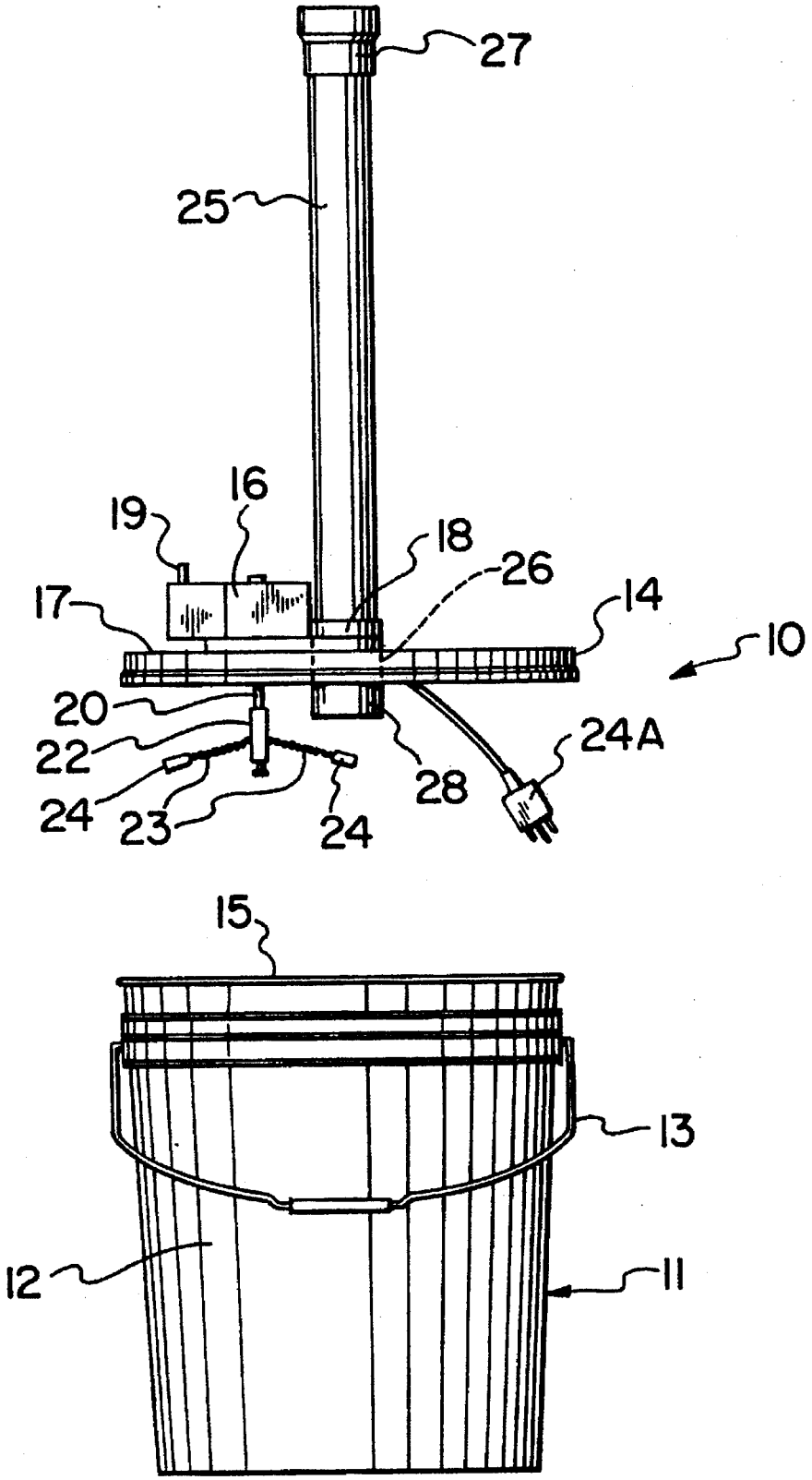

As seen in the drawing, the present invention provides a bulb crusher 10 including a base 11 consisting of a holding unit 12. The holding unit 12 may be in the shape of a hollow, inverted frusto-conical pail. The pail 12 also includes a carrying handle 13. While not shown, the pail 12 is preferably provided with a disposable plastic liner, e.g., a conventional plastic garbage bag.

A protective lid 14 adapted to be removably placed atop the open access 15 to the pail 12. The protective lid 14 is also adapted to hold the plastic liner in place. The protective lid includes a motor 16, e.g., a 110 v. electric motor secured to the top 17 thereof by a motor clamp 18. The motor 16 is provided with an on/off switch 19. Although not shown, a safety switch is provided in association between the lid 14 and the pail 12 to that the motor switch 19 is inoperative when the lid 14 is removed for the pail 12. The motor shaft 20 of the motor 16 projects downwardly through the protective lid 14 and below the lower surface by approximately 2". Secured to the motor shaft is a connecting hub 22 to which is attached the crusher means. In accordance with the present invention, the crusher means comprises at least two equiangularly-disposed multi-stranded, braided, wire cables 23, having a weight 24 attached to each end. The improved crusher means tend to increase the efficiency with which the lamps are crushed or shattered upon entering the holding unit. Thus, because of the very rough surface of the multi-stranded, braided, wire cable, the tubes are first broken into small particles and then are ground by abrasion into very fine uniform particles. As a side effect of such very fine uniform grinding, a pressure ambient is generated in the holding unit 12 which prevents any undesirable backup into an inlet means, and impels the ground glass and other residue into the plastic liner.

A conventional 110 v. plug 24 provides electric power to the motor 16.

A hollow tube shaft 25 acting as a bulb chute is secured to a circular aperture 26 in the protective lid 14. The hollow tube shaft 25 projects downwardly below the lower face 21 of the protective lid 14, and projects upwardly as chute 27, to provide an access opening for the fluorescent lamps. It terminates as outlet tube 28 into the holding unit.

During operation, as the portion of a fluorescent tube exiting from the outlet tube 28 it is broken and ground by the novel crushing member 23,24 of this invention. The unbroken portion of the fluorescent tube moves downwardly through the inlet chute 25 until the entire fluorescent tube is broken and deposited in the can.

CONCLUSION

Variations can be made in the above-described preferred embodiment, as will be understood by one skilled in the art. For example, it is not necessary that the lid be a plastic lid, nor that the can be a plastic trash can. The can and lid can be metal, for example, and the can be of various sizes and shapes. The motor, the inlet chute, and the switch can, of course, be mounted to the lid in other arrangements than that specifically shown. The inlet chute can be a single tube. Alternatively, the inlet chute can comprise two separate tubes, if desired. Other types of glass (or other material) tubes than fluorescent tubes can also, of course, be disposed of by the apparatus of the present invention.

The disposal apparatus of the present invention is preferably entirely mounted on the lid of a mating, open-top container. The term "mating" as used herein means that the lid fits on the container and completely covers the container opening, as in the standard trash can and lid.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. Apparatus for disposing of elongated cylindrical fluorescent light bulbs, comprising:

(a) an open-topped container of circular cylindrical cross-section;

(b) a substantially-flat lid adapted removably to mate with, and to cover, the top of said container, said lid having an upper surface, and a lower surface which is adapted to be directed toward said container;

(c) a hollow cylindrical light bulb feed chute which is disposed along the central longitudinal axis of said lid and which extends through said lid and which is attached thereto, said feed chute having an inlet opening which is disposed above the upper surface of said lid and an outlet opening which is disposed below the lower surface of said lid, the inside diameter of said hollow cylindrical chute being adapted closely to accommodate said cylindrical fluorescent tube, said feed chute extending perpendicularly through said lid;

(d) an electric motor which is mounted upon the upper surface of said lid and which is clamped thereto, said motor having a downwardly-extending rotatable shaft, which projects through said lid and which terminates below the lower surface of said lid;

(e) on-off electrical switch means operatively associated with said electric motor; and (f) means for pulverizing said cylindrical light bulb, as it emerges from the cutlet opening of said hollow cylindrical feed chute, said means comprising a hub at the terminal end of said shaft, and at least two equiangularly-disposed, rough multi-stranded, braided, wire cables secured to said hub, each said multi-stranded, braided, wire cable being provided with a terminal weight;

whereby, when said shaft is rotating, each said rough multi-stranded, braided, wire cable extends by centrifugal force across the outlet opening of said hollow cylindrical chute, thereby to pulverize said bulb by first breaking the hollow cylindrical light bulb into small particles and then grinding the small particles by abrasion against the rough surface of each multi-stranded, braided wire cable, thereby simultaneously generating a pressure ambient to prevent undesirable backup into the inlet of said hollow cylindrical chute, each of said multi-stranded braided wire cables striking said hollow cylindrical light bulb at an angle to the direction of feeding of the light bulb, in turn, as said shaft rotates.

2. The apparatus of claim 1 including an electrical safety switch pendently supported by the lower surface of said lid, said safety switch being adapted to inactivate said motor when said lid is raised from said open-topped container.

3. The apparatus of claim 1 including a plastic liner bag, the open upper extremity of which drapes over the open top of said container said bag being held in such position by said lid, said plastic liner bag providing a disposable vessel for said pulverized fluorescent light bulb.

* * * * *